US006394069B1

(12) United States Patent
Kondo

(10) Patent No.: US 6,394,069 B1
(45) Date of Patent: May 28, 2002

(54) APPARATUS FOR CONTROLLING INTERNAL COMBUSTION ENGINE AT DECELERATING STATE

(75) Inventor: Wakichi Kondo, Kariya (JP)

(73) Assignee: Denso Corporation, Kariya (JP)

( * ) Notice: Subject to any disclaimer, the term of this patent is extended or adjusted under 35 U.S.C. 154(b) by 13 days.

(21) Appl. No.: 09/608,153

(22) Filed: Jun. 30, 2000

(30) Foreign Application Priority Data

Jul. 8, 1999 (JP) ..... 11-193857

(51) Int. Cl.[7] ..... F02D 41/16

(52) U.S. Cl. ..... 123/339.19; 123/339.23; 123/493; 123/325

(58) Field of Search ..... 123/339.11, 339.19, 123/339.21, 339.23, 352, 325, 493, 585

(56) References Cited

U.S. PATENT DOCUMENTS 4,570,592 A * 2/1986 Otobe ..... 123/339.23
5,065,717 A * 11/1991 Hosokai et al. ..... 123/339.23
5,191,865 A * 3/1993 Minamitani et al. ... 123/339.21

FOREIGN PATENT DOCUMENTS

| | | | |
|---|---|---|---|
| JP | 63-71539 | 3/1988 | |
| JP | 6-299909 | 10/1994 | |
| JP | 10-311236 | 11/1998 | |
| JP | 11-125139 | * 5/1999 | ..... 123/585 |

* cited by examiner

*Primary Examiner*—Willis R. Wolfe
(74) *Attorney, Agent, or Firm*—Nixon & Vanderhye P.C.

(57) ABSTRACT

An apparatus for controlling an internal combustion engine controls an air amount bypassing a throttle valve of the engine. The air amount is decreased according to a difference between an actual rotational speed and a target rotational speed after a completion of a fuel-cut. Therefore, the rotational speed is quickly lowered. The decrease control is finished when the actual rotational speed reaches near a target rotational speed, simultaneously a feedback control is started. The feedback control accurately maintains the actual rotational speed at the target rotational speed. As a result, it is possible to improve fuel consumption and to prevent a stall and a vibration of the engine.

20 Claims, 4 Drawing Sheets

APPARATUS FOR CONTROLLING INTERNAL COMBUSTION ENGINE AT DECELERATING STATE

CROSS REFERENCE TO RELATED APPLICATION

This application is based on Japanese Patent Application No. Hei 11-193857 filed on Jul. 8, 1999, the content of which is incorporated herein by reference.

BACKGROUND OF THE INVENTION

1. Field of the Invention

The present invention relates to an apparatus for controlling an internal combustion engine (hereinafter referred to an engine) when the engine is required to decelerate a rotational speed.

2. Description of Related Art

JP-A-63-71539 discloses an idle speed control system (hereinafter referred to an ISC) having an ISC valve for varying an amount of air bypassing a throttle valve. In this apparatus, a target rotational speed is set relatively low to save fuel consumption when an actual rotational speed is slowly lowered. On the contrary, the target rotational speed is set relatively high to prevent an engine stall when the actual rotational speed is rapidly lowered. However, since the system has a delay, the target rotational speed must be set sufficiently high from a final target rotational speed to prevent a stall and a vibration of the engine. Such a high target rotational speed causes a delay on the ISC and increases fuel consumption.

SUMMARY OF THE INVENTION

The present invention addresses these drawbacks.

It is therefore an object of this invention to provide an apparatus for preventing a stall of the engine and improving fuel consumption.

It is a further object of this invention to provide an apparatus for controlling the rotational speed of the engine to a target rotational speed quickly.

According to a first aspect of the present invention, an air amount bypassing a throttle valve is decreased according to a difference between an actual rotational speed and a target rotational speed when the engine is operated under a predetermined decelerating state. Therefore, the rotational speed of the engine is quickly lowered.

According to a second aspect of the present invention, a feedback control is started after a completion of the decrease control. Therefore, the rotational speed can be stably maintained at the target rotational speed after a quick lowering by the decrease control.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Figure 1:
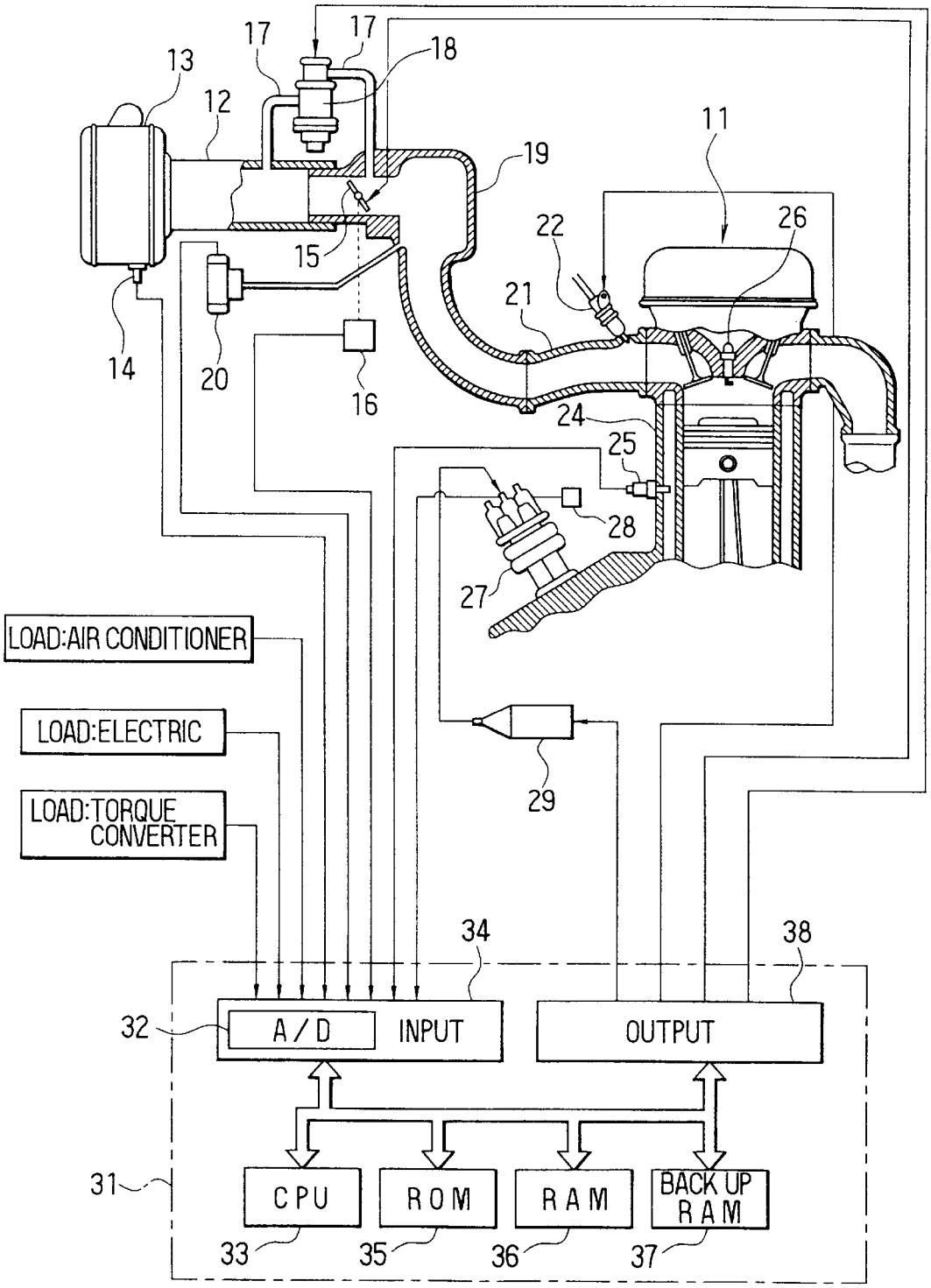
FIG. 1 is a block diagram of an engine control system according to a first embodiment of the present invention.

FIG. 1 shows a schematic block diagram of an engine control system of the vehicle according to a first embodiment. In this embodiment, the present invention is applied to a bypass air control type ISC system. The engine 11 has an intake passage 12 and an air cleaner 13. An intake air temperature sensor 14 is provided to the air cleaner. A throttle valve 15 operated in accordance to an operating amount of an accelerator pedal is disposed in the intake passage 12. A throttle sensor 16 is provided to detect an opening degree of the throttle valve 15. The throttle sensor 16 has an idle switch (not shown) for detecting a fully closed state of the throttle valve 15. A bypass passage 17 is provided to bypass the throttle valve 15. An ISC valve 18 for varying a passage area of the bypass passage 17 in response to a drive signal is disposed in the bypass passage. A surge tank 19 is disposed in a downstream of the throttle valve 15. An intake pressure sensor 20 is connected to the surge tank 19 to detect a pressure of air in the surge tank 19. An intake manifold 21 is disposed between the surge tank 19 and the engine 11 to provide passages to cylinders of the engine 11. Fuel injectors 22 are disposed in each of branch passages of the intake manifold to supply fuel to each of the cylinders. A water temperature sensor 25 is disposed in a water jacket 24 of the engine 11 to detect a water temperature of the engine 11 as an engine temperature. An ignition system has an ignition plug 26, a distributor 27, a rotational speed sensor 28 for providing a signal indicating a rotational speed NE of the engine 11 and an ignition coil 29. An engine control circuit unit (hereinafter referred to an ECU) 31 is constructed as a microcomputer including a CPU 33, an input circuit having an A/D converter 32, a ROM 35, a RAM 36, a BACK-UP RAM 37, and an output circuit 38. The ECU 31 inputs a plurality of signals such as signals from the sensors 14, 16, 20, 25 and 28, and signals indicating a load of an air conditioner, a load of electrical devices, a load of a torque converter and the like through the input circuit 34. The ECU 31 provides drive signals for the ISC valve 18, the throttle valve 15, the injectors 22 and the ignition coil 29 through the output circuit 38. The ECU 31 controls the system in accordance with memorized programs such as a fuel injection control, an ignition control and a bypass air control. In this embodiment, the bypass air control contains a feedback control for varying the bypass air amount according to the rotational speed by using a feedback control method and a decrease control for decreasing the bypass air amount compulsorily.

Figure 2:
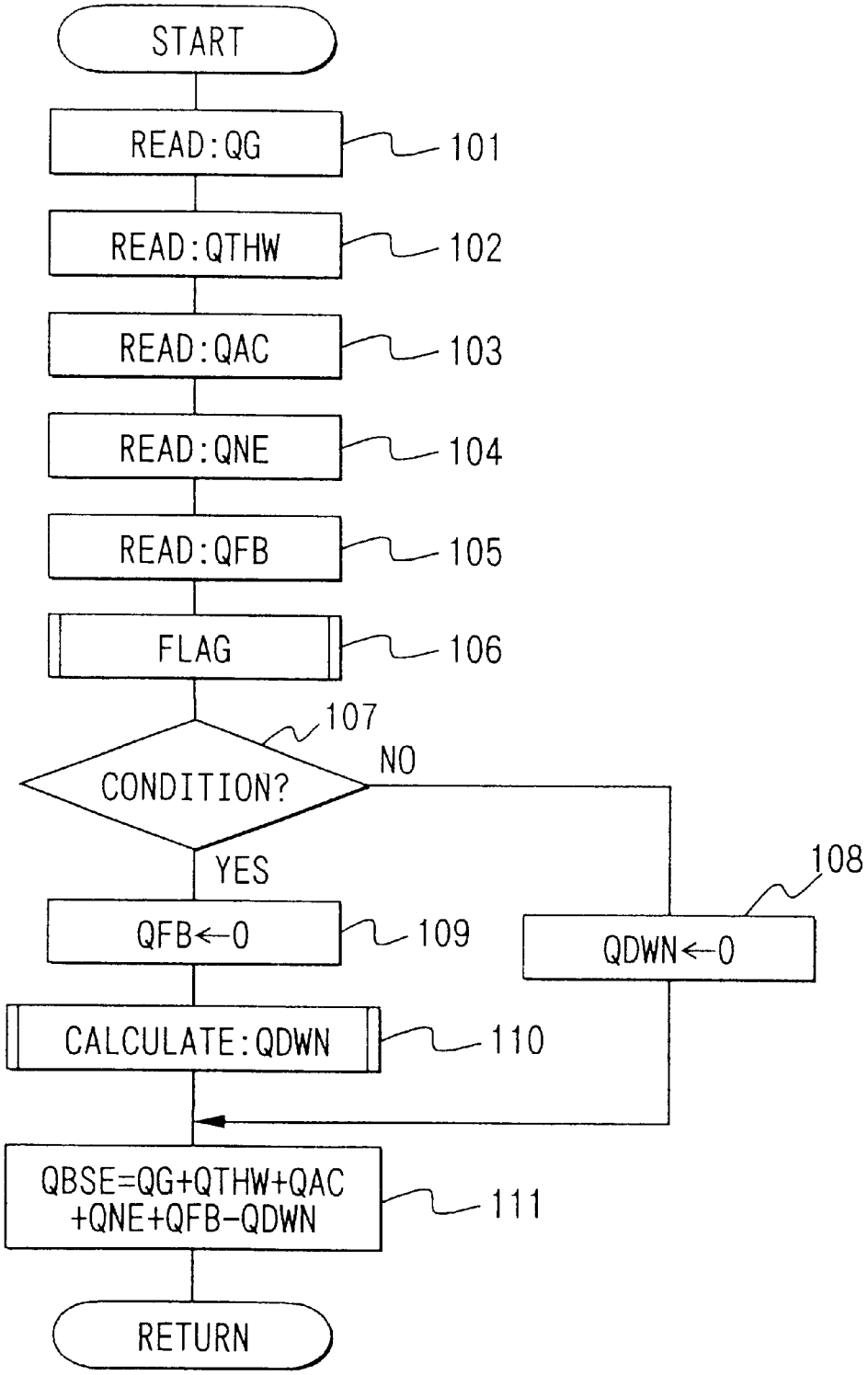
FIGS. 2 to 4 are flowcharts of the engine control system according to the first embodiment of the present invention.
Figure 3:
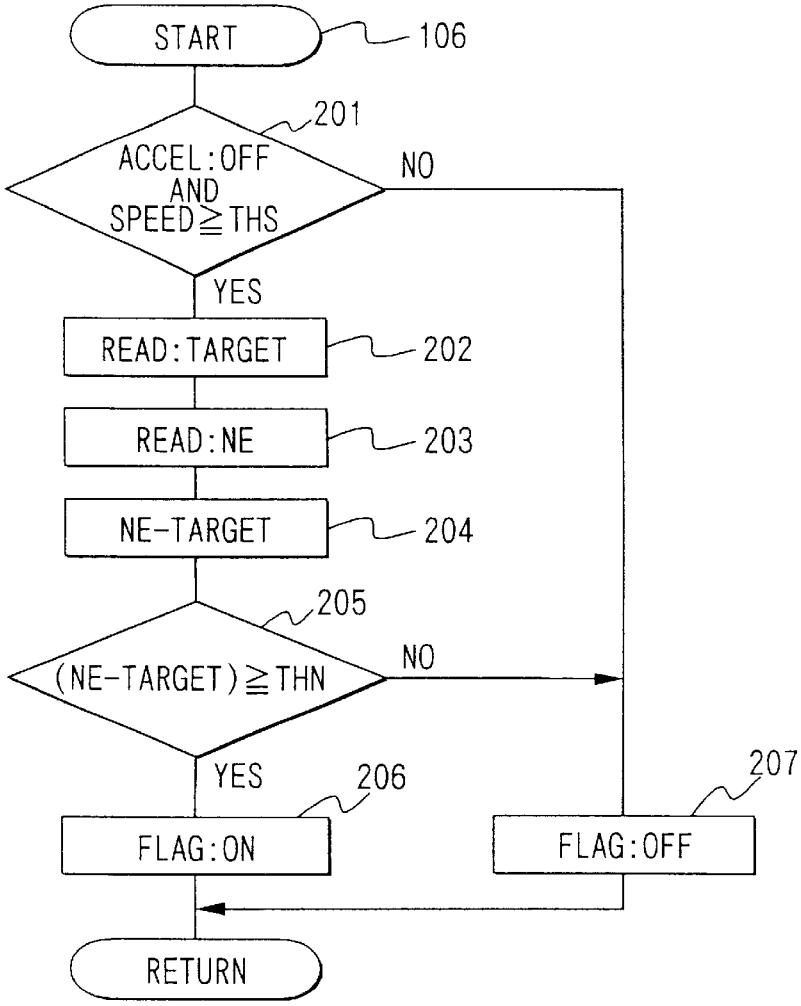
Figure 4:
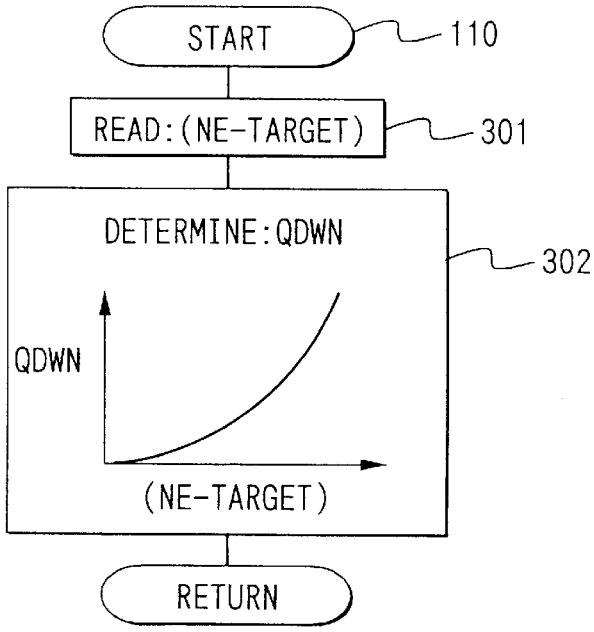

FIG. 2 through FIG. 4 show flowcharts of the feedback control and the decrease control. FIG. 2 shows a routine for calculating a command value of a bypass air amount. The routine runs every predetermined time by an interrupt processing method. FIG. 3 shows a routine for determining a deceleration of the engine. The routine determines whether the engine is in a predetermined deceleration state or not, and acts as a means for determining a deceleration. FIG. 4 shows a routine for calculating a correction value of the bypass air amount.

At step 101, the ECU 31 reads a learned value QG of the bypass air amount. Here, the learned value QG is learned to correct a deviation of a control characteristic, is memorized in the back-up RAM 37, and renewed at the idle state. At step 102 through step 105, the ECU 31 reads a plurality of correction values. For instance, a water temperature correction value QTHW is obtained by a map or the like according to a water temperature detected by the water temperature sensor 25. An air conditioner correction value QAC is obtained by a map or the like according to a load of the air conditioner. A rotational speed correction value QNE is obtained by a map according to a changing speed of the rotational speed. A feedback correction value QFB is calculated by a usual feedback control method such as a PID control method. In this embodiment, the feedback correction value QFB is set to control the bypass air amount so that the actual rotational speed is controlled to a target rotational speed. The feedback control by using the feedback correction value QFB is started after a completion of the decrease control. Such the rotational speed control acts as a means for controlling the rotational speed at an idle state.

At step 106, the routine shown in FIG. 3 is executed. At step 201, it is discriminated that whether a condition is met or not. In this embodiment, the condition includes, the accelerator pedal is not operated by a driver (accel:off), and a vehicle speed is not less than a predetermined value (speed≧THS). In a case of "No", the program proceeds to step 207, the flag is set "OFF".

On the other hand, in a case of "Yes", the program executes steps 202 through 206. At step 202 and 203, the ECU 31 reads the target rotational speed TARGET and the present rotational speed NE detected by the sensor 28. At step 204, a difference between the NE and the TARGET is calculated. At step 205, it is discriminated whether the difference (NE-TARGET) is not less than the predetermined value THn or not. Here, the value THn is defined as a sufficient value to prevent the stall of the engine and the bad vibration. In a case of "No", the process branches to step 207. In a case of "Yes", the flag is set "ON" at step 206.

Referring to FIG. 2 again, at step 107, it is discriminated whether a condition is met or not. In this embodiment, for instance, the condition includes the following conditions: (1) the flag is "ON", (2) it is not in a fuel-cut mode, (3) the water temperature is not less than a predetermined value, and (4) a rotational speed change. NE is not bigger than a predetermined value. The condition (2) prohibits an execution of the decrease control when the engine 11 runs under the fuel-cut mode in which a fuel injection is cut to save fuel. The condition (3) prohibits an execution of the decrease control when the engine runs under a cold condition, for avoiding an increasing of an emission of an exhaust, because fuel adhered on a wall is increased when the engine is cold. The condition (4) prohibits an execution of the decrease control when the rotational speed of the engine is rapidly lowered, for avoiding an excess drop of the rotating speed and preventing the stall and the vibration of the engine. If any one of the conditions is not met, the program branches "No", and the correction value QDWN is set "0" at step 108. On the other hand, in a case of "Yes", the process proceeds to step 109 and 110. The feedback correction value QFB is set "0" at step 109. At step 110, the correction value QDWN is calculated.

Referring to FIG. 4, at step 301, the ECU 31 reads the difference (NE-TARGET). At step 302, the ECU 31 calculates the correction value QDWN according to the difference (NE-TARGET) by using a map or an expression. In this embodiment, as shown in FIG. 4, a relationship between the correction value QDWN and the difference (NE-TARGET) is defined so that the correction value QDWN is increased as the difference (NE-TARGET) increases.

Referring to FIG. 2 again, at step 111, the command value QBSE is calculated by the following expression.

$$QBSE=QG+QTHW+QAC+QNE+QFB-QDWN$$

After that, the ECU 31 calculates a duty ratio of the ISC valve 18 according to the command value QBSE, and drives the ISC valve 18 by a driving signal having a calculated duty.

Figure 5:
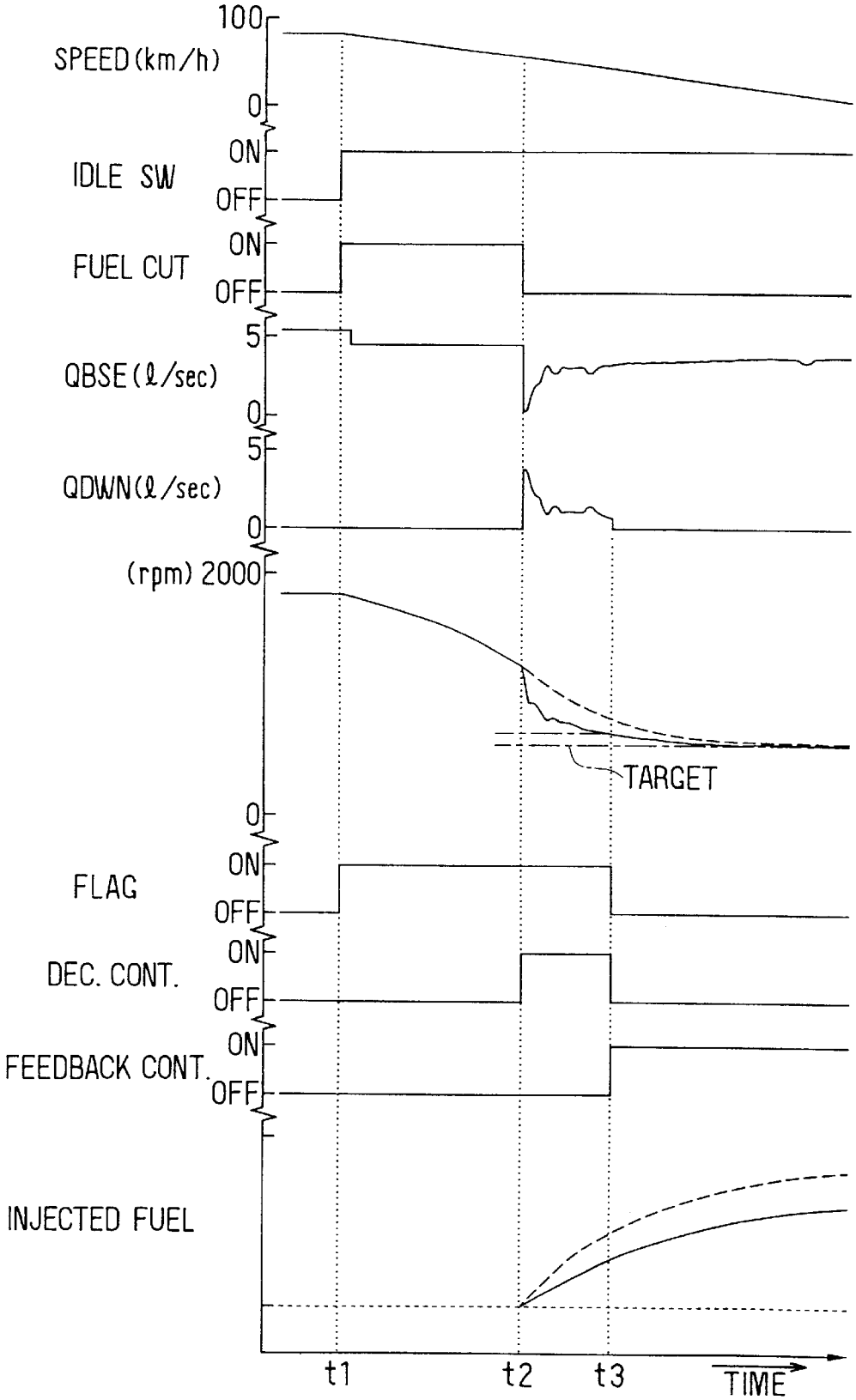
FIG. 5 is a graph showing signals of the system according to the first embodiment of the present invention.

A typical operation of this embodiment is shown in FIG. 5 by solid lines, the broken line shows that of the prior art. Referring to FIG. 5, the accelerator pedal is released at a time t1, when the vehicle runs at some speed. Simultaneously, the throttle valve is fully closed in response to the accelerator pedal, and the idle switch is turned on. In a case that conditions for the fuel-cut mode are met, the ECU 31 turns into the fuel-cut mode. At step 206, the flag is set "ON". After that, the rotational speed of the engine is gradually lowered. At a time t2, the rotational speed of the engine reaches below a lower limit of the fuel-cut mode, the fuel-cut mode is completed. Therefore, the decrease control is started when the conditions in step 107 are met at the time t2. During the decrease control, the correction value QDWN is calculated based on the difference between the rotational speed NE and the target rotational speed TARGET, and is subtracted from the basic bypass air amount (QG+QTHW+QAC+QNE). Therefore, the rotational speed is decreased quickly. At a time t3, the difference (NE-TARGET) reaches below a predetermined value, the flag is set "OFF" at step 207, and this causes a completion of the decrease control and a start of the feedback control. During the feedback control, the ECU 31 calculates the QFB by using a usual feedback control method such as a PID control so that the rotational speed becomes the target rotational speed, and adds the QFB to the basic bypass air amount (QG+QTHW+QAC+QNE).

In this embodiment, it is possible to prevent the stall of the engine and the vibration even the rotational speed is lowered quickly, because the bypass air amount is decreased according to the difference (NE-TARGET). Therefore, it is possible to improve fuel consumption, since the rotational speed can be controlled near an idle rotational speed quickly. Further, the bypass air amount can be set an optimum amount because the bypass air amount is calculated based on the engine operating condition such as the water temperature, the load of the air conditioner, the changing amount of the rotational speed or the like during the decrease control.

Alternatively, the value NE is replaceable with the other engine operating condition signals indicating a condition that the rotational speed may be rapidly lowered, such as a intake air amount, a intake pressure or the like. Further, the decrease control may be prohibited when said engine is operated under a condition that an accuracy of an air-fuel ratio control by the fuel injection control may be lowered. Further, the basic bypass air amount may be calculated based on a part of the correction values QG, QTHW, QAC, QNE and QFB. The basic bypass air amount may be calculated based on a further correction values such as a load of an electric device, a load of a torque converter or the like. Further, the present invention can apply to a direct drive type ISC system which drives the throttle valve directly to control the rotational speed of the engine. In a case of this system, an opening degree of the throttle valve may be calculated based on the command value QBSE. Further, the command value QBSE may be calculated by using the other expression, a map or the like.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. An apparatus for controlling an internal combustion engine at a decelerating state comprising:

means for varying an air amount introduced into said engine;

means for discriminating whether said engine is operated in a predetermined deceleration state or not; and means for controlling said air amount according to an actual rotational speed and a target rotational speed, wherein said controlling means comprises decreasing means for decreasing said air amount according to a difference between an actual rotational speed and a target rotational speed when said predetermined decelerating state is discriminated by said discriminating means;

wherein said controlling means further comprises prohibiting means for prohibiting decrease control by said decreasing means when a fuel supply to said engine is cut; and wherein said prohibiting means prohibits said decrease control when said engine is operated under a condition that an accuracy of an air-fuel ratio control may be lowered.

2. An apparatus for controlling an internal combustion engine at a decelerating state comprising:

means for varying an air amount introduced into said engine;

means for discriminating whether said engine is operated in a predetermined deceleration state or not; and means for controlling said air amount according to a difference between an actual rotational speed and a target rotational speed and a operating condition of said engine;

wherein said controlling means comprises decreasing means for decreasing said air amount and prohibiting means for prohibiting a decrease control by said decreasing means when a fuel supply to said engine is cut; and wherein said prohibiting means prohibits said decrease control when said engine is operated under a condition that an accuracy of an air-fuel ratio control may be lowered.

3. A method for controlling an internal combustion engine during a decelerating state, the method comprising:

varying an air amount introduced into said engine;

discriminating whether said engine is operated in a predetermined deceleration state or not; and controlling said air amount according to an actual rotational speed and a target rotational speed;

wherein said controlling comprises decreasing said air amount according to a difference between an actual rotational speed and a target rotational speed when said predetermined decelerating state is discriminated;

wherein decreasing said air amount continually decreases said air by a predetermined amount, said predetermined amount being increased as said difference between an actual rotational speed and a target rotational speed increases; and wherein said controlling comprises feedback for controlling said air amount by using a feedback control method so that said rotational speed is controlled to a target rotational speed, said feedback control beginning after completion of decrease control during said decreasing of the air amount.

4. A method of controlling an internal combustion engine at a decelerating state, the method comprising:

varying an air amount introduced into said engine;

discriminating whether said engine is operated in a predetermined deceleration state or not; and controlling said air amount according to a difference between an actual rotational speed and a target rotational speed and an operating condition of said engine;

wherein said controlling comprises feedback controlling said air amount by using a feedback control method so that said rotational speed is controlled to a target rotational speed and decrease controlling in which said air amount is decreased, wherein the feedback control is started after a completion of the decrease control; and wherein a predetermined amount is decreased from said air amount, said predetermined amount being increased as said difference increases.

5. A method for controlling an internal combustion engine during a decelerating state, the method comprising:

varying an air amount introduced into said engine;

discriminating whether said engine is operated in a predetermined deceleration state or not; and controlling said air amount according to an actual rotational speed and a target rotational speed;

wherein said controlling comprises decrease controlling said air amount such that the air amount is decreased according to a difference between an actual rotational speed and a target rotational speed when said predetermined decelerating state is discriminated;

wherein the decrease control is prohibited when a fuel supply to said engine is cut; and wherein the decrease control is prohibited when said engine is operated under a condition that an accuracy of an air-fuel ratio control may be lowered.

6. A method of controlling an internal combustion engine at a decelerating state, the method comprising:

varying an air amount introduced into said engine;

discriminating whether said engine is operated in a predetermined deceleration state or not; and controlling said air amount according to a difference between an actual rotational speed and a target rotational speed and a operating condition of said engine;

wherein the controlling comprises decreasing said air amount and prohibiting a decrease control when a fuel supply to said engine is cut; and wherein the decrease control is prohibited when said engine is operated under a condition that an accuracy of an air-fuel ratio control may be lowered.

7. An apparatus for controlling an internal combustion engine at a decelerating state, the apparatus comprising:

an air controller for varying an air amount introduced into said engine;

discriminator for discriminating whether said engine is operated in a predetermined deceleration state or not; and a controller for controlling said air amount introduced into said engine via the air controller according to an actual rotational speed and a target rotational speed, wherein said controller provides decrease control in which said air amount is decreased according to a difference between an actual rotational speed and a target rotational speed when said predetermined decelerating state is discriminated by said discriminator, the decrease control being accomplished by the controller without using feedback control;

wherein said controller provides feedback control for controlling said air amount by using a feedback control method so that said rotational speed is controlled to a target rotational speed, said feedback control starting after a completion of said decrease control.

8. An apparatus according to claim 7, wherein the decrease control comprises decreasing a predetermined amount from said air amount, the predetermined amount being decreased as the difference between the actual and target rotational speeds increases.

9. A method for controlling an internal combustion engine during a decelerating state, the method comprising:

varying an air amount introduced into said engine;

discriminating whether said engine is operated in a predetermined deceleration state or not; and controlling said air amount according to an actual rotational speed and a target rotational speed;

wherein said controlling comprises a decrease control and a feedback control;

wherein the decrease control includes decreasing said air amount according to a difference between an actual rotational speed and a target rotational speed when said predetermined decelerating state is discriminated, the decrease control being accomplished without using feedback control; and wherein said feedback control for controlling said air amount includes using a feedback control method so that said rotational speed is controlled to a target rotational speed, said feedback control beginning after completion of said decrease control.

10. The method according to claim 9, wherein the decrease control comprises decreasing said air amount by a predetermined amount, the predetermined amount being increased as said difference increases.

11. An apparatus for controlling an internal combustion engine at a decelerating state comprising:

means for varying an air amount introduced into said engine;

means for discriminating whether said engine is operated in a predetermined deceleration state or not; and means for controlling said air amount according to an actual rotational speed and a target rotational speed, wherein said controlling means comprises decreasing means for decreasing said air amount according to a difference between an actual rotational speed and a target rotational speed when said predetermined decelerating state is discriminated by said discriminating means;

wherein said decreasing means decreases a predetermined amount from said air amount, said predetermined amount being increased as said difference increases; and wherein said controlling means further comprises feedback means for controlling said air amount by using a feedback control method so that said rotational speed is controlled to a target rotational speed, wherein said feedback means starts said feedback control after a completion of decrease control by said decreasing means.

12. An apparatus for controlling an internal combustion engine at a decelerating state according to claim 11, wherein said controlling means further comprises means for calculating a basic air amount, wherein said decreasing means comprises means for calculating a correction value according to said difference and means for subtracting said correction value from said basic air amount.

13. An apparatus for controlling an internal combustion engine at a decelerating state according to claim 11, wherein said discriminating means discriminates said predetermined decelerating state when an accelerator is not operated, a vehicle speed is not less than a predetermined speed, and said difference is not less than a predetermined value.

14. An apparatus for controlling an internal combustion engine at a decelerating state according to claim 11, wherein said controlling means further comprises prohibiting means for prohibiting said decrease control by said decreasing means when a fuel supply to said engine is cut.

15. An apparatus for controlling an internal combustion engine at a decelerating state according to claim 14, wherein said prohibiting means prohibits said decrease control when said engine is operated under a condition that said rotational speed may be dropped excessively.

16. An apparatus for controlling an internal combustion engine at a decelerating state comprising:

means for varying an air amount introduced into said engine;

means for discriminating whether said engine is operated in a predetermined deceleration state or not; and means for controlling said air amount according to a difference between an actual rotational speed and a target rotational speed and an operating condition of said engine;

wherein controlling means further comprises feedback means for controlling said air amount by using a feedback control method so that said rotational speed is controlled to a target rotational speed and decreasing means for decreasing said amount, wherein said feedback means starts said feedback control after a completion of decrease control by said decreasing means; and wherein said controlling means decreases a predetermined amount from said air amount, said predetermined amount being increased as said difference increases.

17. An apparatus for controlling an internal combustion engine at a decelerating state according to claim 16, wherein said controlling means further comprises means for calculating a basic air amount according to said operating condition, means for calculating a correction value according to said difference and means for subtracting said correction value from said basic air amount.

18. An apparatus for controlling an internal combustion engine at a decelerating state according to claim 16, wherein said discriminating means discriminates said predetermined decelerating state when an accelerator is not operated, a vehicle speed is not less than a predetermined speed, and said difference is not less than a predetermined value.

19. An apparatus for controlling an internal combustion engine at a decelerating state according to claim 16, wherein said controlling means further comprises decreasing means for decreasing said air amount and prohibiting means for prohibiting a decrease control by said decreasing means when a fuel supply to said engine is cut.

20. An apparatus for controlling an internal combustion engine at a decelerating state according to claim 19, wherein said prohibiting means prohibits said decrease control when said engine is operated under a condition that said rotational speed may be dropped excessively.

* * * * *